United States Patent [19]

Sadan

[11] Patent Number: 4,746,166

[45] Date of Patent: May 24, 1988

[54] COMBINED PORTABLE SEAT AND CARRYING CASE

[75] Inventor: Yiftah Sadan, Beit Zera, Israel

[73] Assignee: "Ar-Kal" Plastics Products Beit Zera, Israel

[21] Appl. No.: 96,950

[22] Filed: Sep. 15, 1987

[30] Foreign Application Priority Data

Sep. 15, 1986 [IL] Israel ..... 80026

[51] Int. Cl.[4] ..... A47C 4/52

[52] U.S. Cl. ..... 297/17; 297/118; 297/183; 190/8

[58] Field of Search ..... 297/17, 118, 230, 231, 297/183; 190/8

[56] References Cited

U.S. PATENT DOCUMENTS 1,325,164 12/1919 Mowrey ..... 297/17 X
3,092,224 6/1963 O'Neil ..... 297/17 X
3,817,574 6/1974 McNab ..... 297/17
4,079,992 3/1978 Thrift et al. ..... 297/17

*Primary Examiner*—Francis K. Zugel
*Attorney, Agent, or Firm*—Ostrolenk, Faber, Gerb & Soffen

[57] ABSTRACT

Disclosed is a portable seat and carrying case, combined in a single article of manufacture. The seat-case comprises first and second side wall members hinged to each other and rotatable between a closed, case-fashion position and an open, seat-fashion position. The side wall members are identical. Each identical side wall member comprises at each side thereof a pair of outwardly directed, concentric circular bearing surfaces, one being formed outside a projection and the other inside a recess. The projecting bearing surface of one side matches the recessed bearing surface of the other side of each of the side wall members, and, when coupled to each other, they form a hinged connection therebetween. A bottom member forms part of and rotatably supports the side wall members in their coupled position.

10 Claims, 4 Drawing Sheets

COMBINED PORTABLE SEAT AND CARRYING CASE

BACKGROUND OF THE INVENTION

The present invention relates to hand-carried cases or bags, and more particularly to dual-function foldable cases which, in their open position may be used as a seat with a back-rest, whose use is convenient for the beach and other outdoor activities such as picnics and the like. Still more specifically, the invention concerns a foldable case of the type disclosed in Israel Patent Specification No. 57687 dated June 29, 1979. In this publication there has been disclosed a case comprised of a pair of side wall members each provided with a lower, partly cylindrical portion. The side wall members were connected to each other by rivets or pivot pins. One of the wall members included projecting detents that formed a stop for limiting the amount of the relative rotation of the side walls when used as a seat with a back-rest.

It has been found that since the casing members were made of injected plastic, which is of relatively poor mechanical strength as well as low specific surface pressure capabilities, this design has failed from the mechanical point of view; the hinge connections and the detents could not withstand the stress and surface pressure prevailing during use of the case as a seat.

From the manufacturing point of view, the known case suffered another disadvantage in that the side wall members were not identical and required two, rather expensive injection molds for their production.

It is therefore the object of the present invention to provide a case of the type referred to with an improved hinging or pivoting arrangement of strong and durable construction as required under the operational conditions of the article.

It is a further object of the invention that both side wall members be identical, i.e. be produced by one and the same plastic injection mold.

SUMMARY OF THE INVENTION

In order to overcome the above-mentioned disadvantages, there is provided according to the invention a combined portable seat and carrying case. The seat-case comprises first and second side wall members hinged to each other and rotatable between a closed, case-fashion position and an open, seat-fashion position. The side wall members are identical, each comprising at each side thereof a pair of outwardly directed, concentric circular bearing surfaces, one being formed outside a projection and the other inside a recess. The projecting bearing surface of one side matches the recessed bearing surface of the other side of each of the side wall members, thus forming together, when coupled the hinged connection therebetween. A bottom member is further provided, forming part of and rotatably supporting the side wall members in their coupled position.

BRIEF DESCRIPTION OF THE DRAWINGS

The invention will be more fully understood in the light of the ensuing description of a preferred embodiment thereof, given by way of example only, with reference to the accompanying drawings wherein.

DETAILED DESCRIPTION OF THE PREFERRED EMBODIMENT

Figure 1:
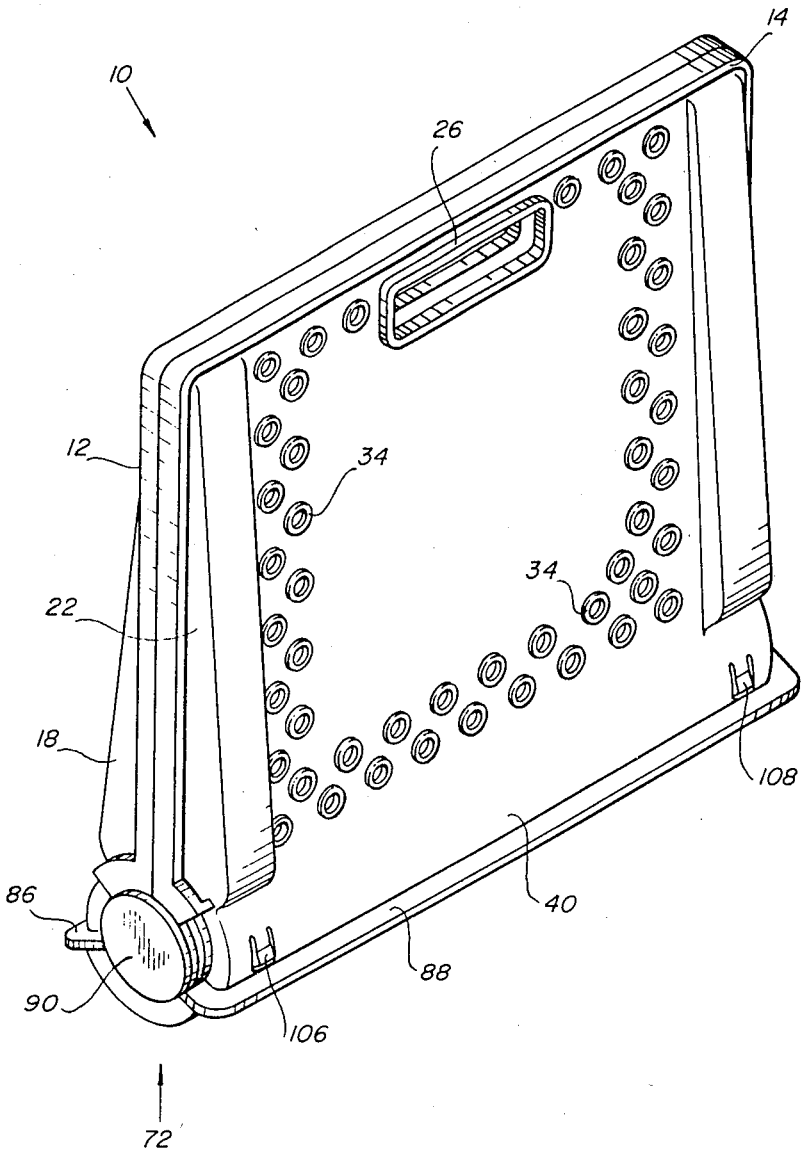
FIG. 1 is a three-dimensional view of the case according to the invention in its folded, handbag position.
Figure 2:
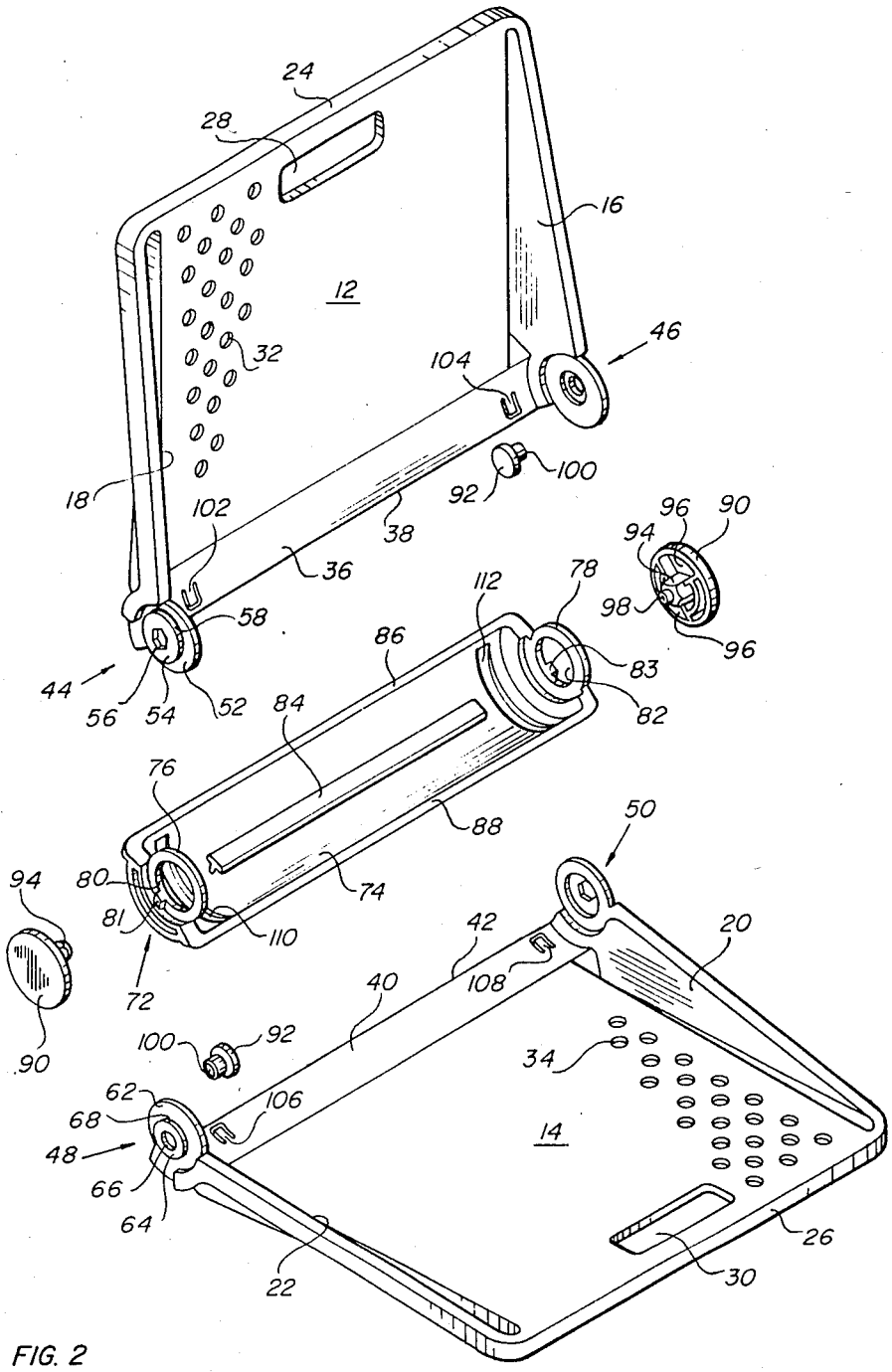
FIG. 2 is an exploded, three-dimensional view of the case members.

Seat-case 10 in FIG. 1 comprises first and second side wall members 12 and 14 which, as will be explained further below, are identical and mounted in a face-to-face position as shown and therefore may be produced by only one plastic injection mold.

Each side wall member is generally planar, having wedge-like side portions 16, 18 for the member 12 and 20, 22 for the member 14. The side wall members are further provided with handles 24, 26 received by providing rectangular openings 28 and 30, respectively.

Figure 3:
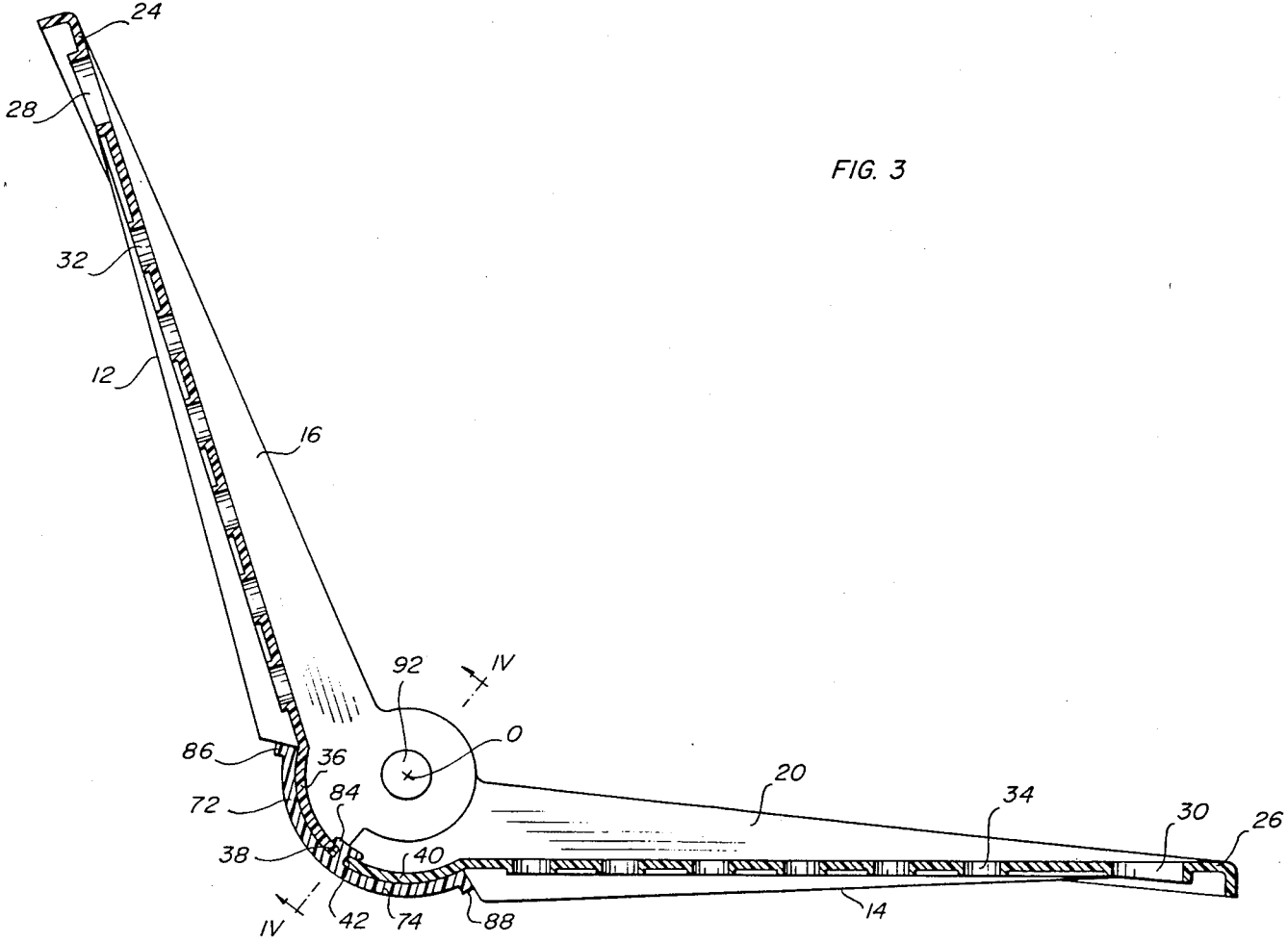
FIG. 3 is a longitudinal cross-section of the case in its open position.

For decorative purposes—as well as economy of material—a plurality of openings 32, 34 is provided, as shown. The member 12 terminates with an arcuate portion 36, forming a part of a cylinder about an axis O as clearly shown in FIG. 3, which portion ends by flat edge or lip 38. Cylindrical portion 40 with edge 42 is associated with the other side wall members 14.

Finally, side wall member 12 is provided with first and second, non-identical bearings or journal portions generally denoted 44 and 46 at each side of it, which cooperate with complementary bearing portions 48 and 50 of the member 20 in a manner to be now described in detail, which presents one of the major features of the present invention. Obviously, in view of the above, bearing portion 44 is identical to portion 50 and portions 46 and 48 are identical as well, only that in the assembled position of the article there are coupled to each other the portions 44 and 48, and 46 and 50, respectively, all in the manner that will be described in detail below.

Hence, portion 44 consists of a double disk structure comprising an outer annular portion 52 integrally made with raised or projecting annular portion 54 provided with a hexagonal opening 56. Thus, there are formed a first, projecting circular or cylindrical projection 58 and a second, recessed cylindrical portion 60 (FIG. 4), all concentric with the opening 56 and with the cylindrical portion 36, i.e. about the axis O.

The counter bearing 48 is essentially of the same construction, namely having a disk 62, raised portion 64 and opening 66, only that the diameter of the opening 66, outer projecting circular portion 68, as well as its associated inner recessed circular portion 70—all aligned with the axis O—are smaller so that the projecting portion 68 can be freely received within the recessed circular portion 60 and rotationally supported thereby; the opening 66 is, however, circular rather than hexagonal as the opening 56.

Figure 4:
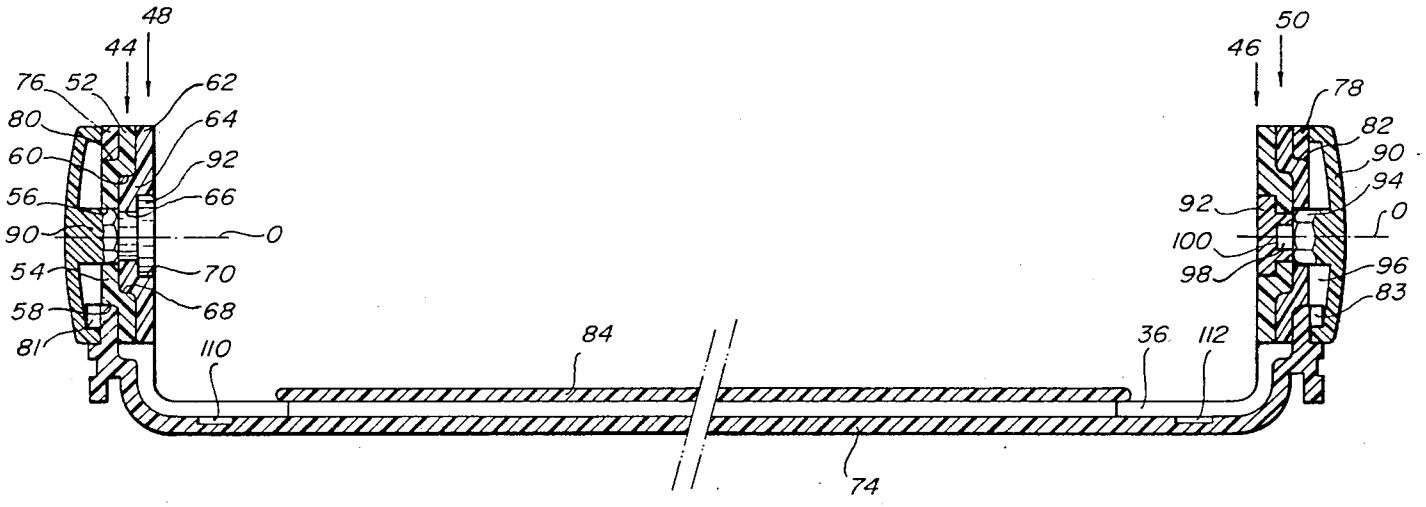
FIG. 4 is a cross-section taken along lines IV—IV of FIG. 3

The same construction and relationship of dimensions is of course valid for the pair of matching bearing portions 46 and 50 at the other side of the article and therefore need not be again described (cf. right side of FIG. 4). The casing assembly comprises a third, bottom member generally denoted 72 which is trough-shaped of a cylindrical cross-section about the axis O having a pair of opposite side sections 76 and 78 defining openings 80 and 82 of identical diameter, which diameter is slightly greater than the diameter of the projecting circular portion 58 of the bearing configuration 44 (and of course, of its counterpart 50 at the opposite side). At the lowermost, bottom part of openings 80, 82 sidewise projections 81 and 83 are formed.

The bottom member 72 is further provided with an elongated T-shaped projection 84 extending substantially all along the member 78 at the middle between edges 86 and 88. As most clearly seen in FIG. 3, the height of the T-profile is such that edges 38 and 42 of the arcuate portions 36 and 40 snugly fit underneath its two wings while the surfaces 38 and 42 abut against its central web.

For each side of the bearing or hinge mountings, there are provided two pairs of matching plugs denoted 90 and 92, respectively. Plug 90 has a central hexagonal boss 94 which fits snugly into the hexagonal opening 56 of its respective side wall member 12, but does not reach into the next-in-line opening 66 of the other side wall 14, the arrangement being such that the plug associated with hinge assemblly 44-48 is coupled to and rotatable with the side wall member 12, and the plug mounted at the other side (46-50) rotates with the wall 14.

The plug 90 is further provided with cavities 96 (two such cavities are shown but use is made of only one), extending to about a quarter (45 degrees) of the inner circumference of the plug's head. In the assembled position, the protrusions 81 and 83 become nested each in its respective cavity 96 as shown in FIG. 4.

Plugs 92 are press-fitted to the plugs 90 from the inside, e.g. by buttons 98 inserted by friction into sockets 100 made in the plugs 92.

It may already be stated at this stage that the plugs are non-essential as far as the mechanical strength of the hingeable connection of the walls to each other are concerned, but are only provided for aesthetic purposes as well to prevent accidental or unintentional dismounting of the case structure during use, and, due to provision of the protrusions 81 and 83, assure that the bottom member 72 will be properly—i.e. symmetrically—positioned when the case is closed (see below).

Finally, as well as optionally, for holding the case together in its folded position, a click-close arrangement may be provided in the form of springy integrally-formed detents 102, 104 in the member 12, and 106 and 108 in the member 14, cooperating with edges 86 and 88 of the cylindrical bottom member 72 in the closed position (FIG. 1), which detents may be freely accommodated within respective elongated recesses 110, 112 formed in the wall 74 (to avoid continuous strain of the detents in the closed position that may impair their capability to flex open when required).

For the assembly of the structure so far described, the members 12 and 14 will be placed one within the other by their complementary bearing portions, i.e. by mounting their circular projecting portions into the respective recessed portions of their counterparts; in such, still releasable engaged position, both members will be pushed—by somewhat flexing-open of the portions 76 and 78—into place where the bottom member 72 becomes engaged with opening 80 rotatably supported by the shoulder surface 58 at the one side, and the opening 82 surounding the same shoulder 58 of the other side wall member.

The plugs 90 and 92 are then assembled in the manner already discussed above.

It will be now readily understood that through the arrangement as above described, the rotatable movement of the members 12 and 14 with respect to each other takes effect or is supported by relatively large surfaces (the respective projecting and recessed cylindrical portions), thereby reducing by an exponential factor the surface pressure of the engaged parts; in other words, the combined hinge portions will readily withstand forces (moments) much higher than if the members were simply rivetted or pivoted to each other by any pin-based engagement or coupling means.

Furthermore, the opening of the side walls one with respect to the other is again limited by a stop member in the form of the "T" section 84, which again spreads the pressure along a large area; the stop 84 also limits and opposes any upward component force by having the edges 38 and 42 confined in corners of the T-profile and eliminates any possibility of torsional movement between the side walls. Finally, since one side wall is coupled—with a certain amount of angular freedom—to one plug member, and the other side wall to the other plug of the bottom member, as aforedescribed, a situation is prevented where the bottom member 72 "tends" to become "clinched" (by friction) to one of the side walls, and rotate with it when the article is converted from the seat position into the case position, leaving an undesirable open slot at its bottom. Now, because of the symmetry retaining arrangment, whereby the plugs are coupled to the bottom member and rotated in opposite directions, such occurrence is positively prevented.

Consequently, the hinge arrangement according to the invention provides a safe, strong and durable connection although its components may be made of low mechanical strength material such as resinous or other man-made materials.

Various variations and modifications of the invention will be apparent.

What is claimed is:

1. A combined portable seat and carrying case comprising first and second side wall members hinged to each other and rotatable between a closed, case-fashion position and an open, seat-fashion position, characterized in that the side wall members are identical, each comprising at each side thereof a pair of outwardly directed, concentric circular bearing surfaces, one being formed outside a projection and the other inside a recess, the projecting bearing surface of one side matching the recessed bearing surface of the other side of each of the side wall members, forming together when coupled to each other the hinged connection therebetween, and a bottom member forming part of and rotatably supporting the side wall members in their coupled position.

2. The case as claimed in claim 1 wherein the bottom member comprises:

(i) a partly cylindrical portion of a length substantially equal to the width of the side walls;

(ii) opposite side portions at the ends of the cylindrical portion each formed with a circular opening concentric with the cylindrical portion; and (iii) a ridge extending within and in the middle of the cylindrical portion.

3. The case as claimed in claim 2 wherein each of the side wall members comprises:

(i) a generally planar portion merging into a partly cylindrical portion of a diameter slightly smaller than that of the bottom member cylinder, which cylindrical portion terminates with a straight edge;

(ii) opposite side portions at the ends of the cylindrical portion, each formed with a circular opening provided in a circular recess seen from inside, and a circular projection seen from outside the case, the circular projection of one side portion of one side wall being of a diameter slightly smaller than the diameter of the openings of the bottom member side portions, and the associated circular recess being of still smaller diameter, the circular projection of the other side portion of the said one side wall being of a diameter slightly less that the diameter of the said circular recess, the arrangement being such that in the assembled state of the case, the projection of the said one side of each side wall becomes rotatably supported by the respective opening of the bottom member side portions, and the projections of the said other side of each side wall becomes rotatably supported within the respective recesses of the said one side of each side wall, and the said edges abut each against an opposite side of the ridge when the case is opened into the seat-fashion position.

4. The case as claimed in claim 3 wherein the ridge is of a T-shaped cross-section, the said edges being of a width slightly smaller than the height of the T-center web.

5. The case as claimed in claim 4 wherein the side portions of the side walls are provided with openings, a plug being axially inserted at each side through the respective openings.

6. The case as claimed in claim 5 wherein the plug of one side is rotatably coupled to one side wall and the plug of the other side is coupled to the other side wall, the bottom member being coupled to both plugs with a degree of angular freedom so that when the side walls are rotated from their open to their closed position the botton is retained in a symmetric position.

7. The case as claimed in claim 6 wherein each plug axle portion and respective opening are of complementary polygonal cross-section, the botton member being provided with a protrusion projecting into a cavity formed in the respective plug.

8. The case as claimed in claim 7 wherein each plug is closed by a second, complementary plug.

9. The case as claimed in claim 8 wherein each side wall comprises a springy detent, cooperating with a lip portion of the base member for holding the case in the closed position.

10. The case as claimed in claim 9 wherein complementary circular recesses are formed in the bottom member, in alignment with the said detents.

* * * * *